US010919740B2

(12) United States Patent
Hall et al.

(10) Patent No.: US 10,919,740 B2
(45) Date of Patent: Feb. 16, 2021

(54) ADJUSTABLE LENGTH WINCH APPARATUS

(71) Applicant: Hall Labs LLC, Provo, UT (US)
(72) Inventors: David R Hall, Provo, UT (US); Jerome Miles, Spanish Fork, UT (US)
(73) Assignee: Hall Labs LLC, Provo, UT (US)

( * ) Notice: Subject to any disclaimer, the term of this patent is extended or adjusted under 35 U.S.C. 154(b) by 0 days.
(21) Appl. No.: 16/453,983
(22) Filed: Jun. 26, 2019
(65) Prior Publication Data
US 2020/0407202 A1 Dec. 31, 2020
(51) Int. Cl.
*B66D 1/26* (2006.01)
*B66D 1/12* (2006.01)
(52) U.S. Cl.
CPC ..... *B66D 1/26* (2013.01); *B66D 1/12* (2013.01)
(58) Field of Classification Search
CPC ..... B66D 1/12; B66D 1/26
See application file for complete search history.

(56) References Cited

U.S. PATENT DOCUMENTS 300,344 A * 6/1884 Chamblin ..... B66D 1/26 254/286
410,507 A * 9/1889 Fain ..... B66D 1/36 254/278
2,213,766 A * 9/1940 Johnson ..... B62B 3/0625 254/279
6,237,781 B1 * 5/2001 Dahl ..... B62H 3/12 211/17
7,243,870 B2 * 7/2007 Pook ..... A63J 1/028 242/278
7,533,869 B2 * 5/2009 Boda ..... B62H 3/12 254/352
9,527,707 B1 * 12/2016 Fehringer ..... B66F 7/26
9,586,794 B2 * 3/2017 Chung ..... B66D 1/04
2002/0178497 A1 * 12/2002 Thurston ..... A47C 17/84 5/10.1
2005/0104052 A1 * 5/2005 Bilcik ..... B66D 1/26 254/279
2011/0127477 A1 * 6/2011 Kokolis ..... B66D 1/26 254/285
2014/0138340 A1 * 5/2014 Miller ..... B66D 3/04 212/336

* cited by examiner

*Primary Examiner* — Michael E Gallion

(57) ABSTRACT

An adjustable length winch apparatus is disclosed. The adjustable length winch apparatus comprises a first motor, a first drum, a second drum, and a shaft. The first motor is configured to rotate the first drum and the shaft on an axis. The second drum is adapted to be rotated by the shaft on the axis. The shaft and the second drum are configured to adjust the distance between the first and second drum.

16 Claims, 11 Drawing Sheets

ADJUSTABLE LENGTH WINCH APPARATUS

TECHNICAL FIELD

This invention relates generally to winches.

BACKGROUND

Winches, hoists, and pulleys are useful tools for lifting heavy and large items. Often the items that are lifted are large and shaped in a way that makes them difficult to lift. These items may require multiple lifting devices or multiple points of contact to lift evenly. For example, when the item is a platform, multiple points of contact may be desired for even lifting. Additionally, items that are lifted may require a greater amount of force than a single winch, hoist, or pulley can provide due to the maximum load capacity of the lifting device. Multiple lifting devices may be used to lift these heavy items; however, the lifting devices may not lift at the same rate, resulting in uneven lifting. When an item only has one point of contact with a winch, hoist, or pulley, the item being lifted may become unstable or uneven as it is lifted. Unstable lifting could result in an uneven plane of storage. This could result in falling items and create an unsafe environment for the user of the winch, hoist, or pulley.

SUMMARY

In a first aspect, the disclosure provides an adjustable length winch apparatus. The adjustable length winch apparatus comprises a first motor, a first drum, a second drum, and a shaft. The first motor is configured to rotate the first drum and the shaft on an axis. The second drum is adapted to be rotated by the shaft on the axis. The shaft and the second drum are configured to adjust the distance between the first and second drum.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

Figure 1:
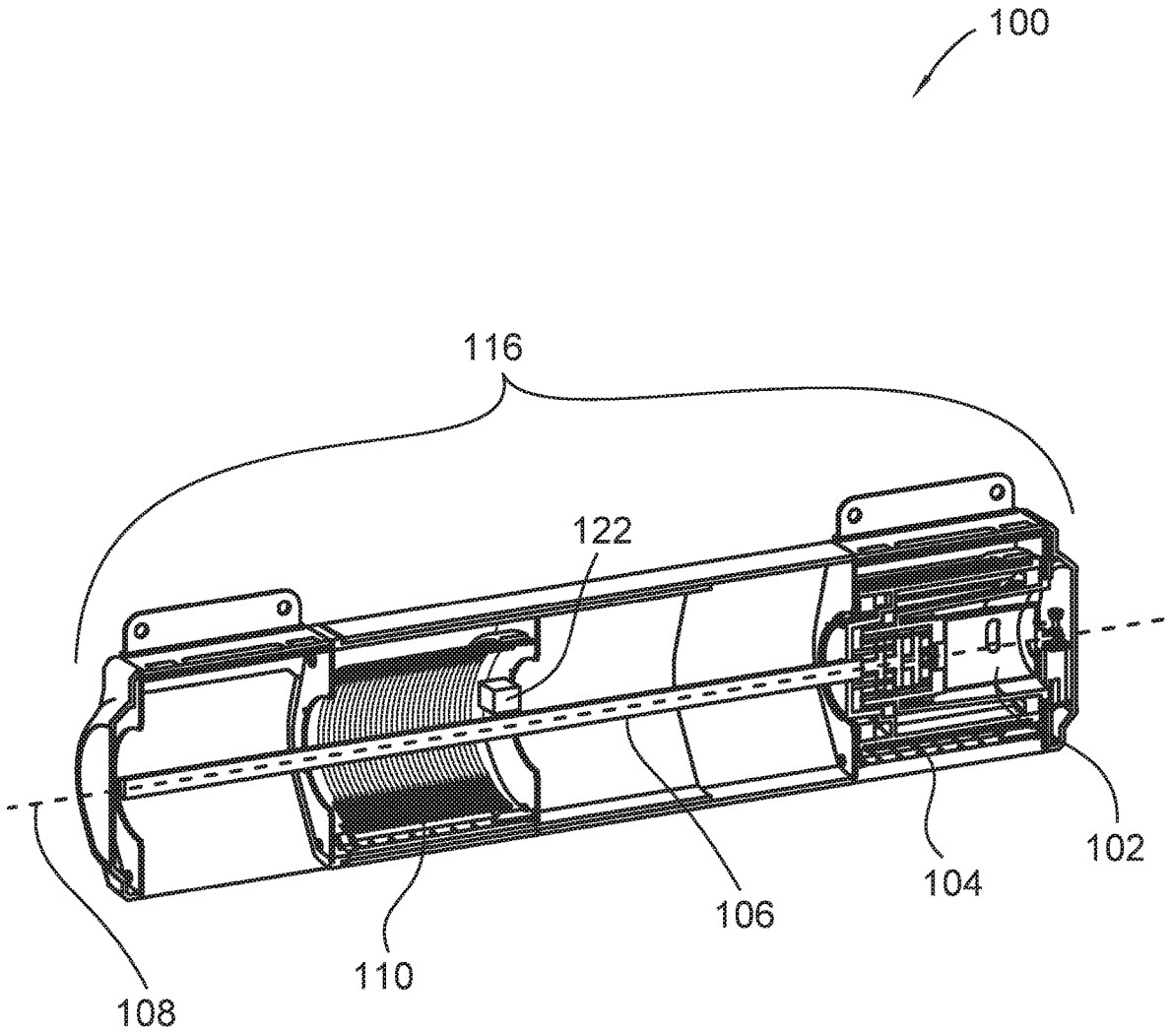
FIG. 1 is a cutaway side view of an adjustable length winch apparatus.

Now referring to FIG. 1, a cutaway side view of an adjustable length winch apparatus is shown at 100, according to one embodiment of the present invention. The adjustable length winch apparatus includes first motor 102. First motor 102 is configured to rotate first drum 104 and shaft 106 on axis 108. The adjustable length winch apparatus includes second drum 110. Second drum 110 is rotated by shaft 106 and is configured to adjust the distance between first drum 104 and second drum 110 by sliding along shaft 106. Actuator 122 is configured to slide second drum 110 along shaft 106. First drum 104 and second drum 106 rotate simultaneously, providing stability and balance to objects being lifted by the adjustable length winch apparatus. First drum 104 is attached to a fixed position on shaft 106. The adjustable length winch apparatus has housing 116. Housing 116 is configured to be mounted to a disparate object.

Figure 2:
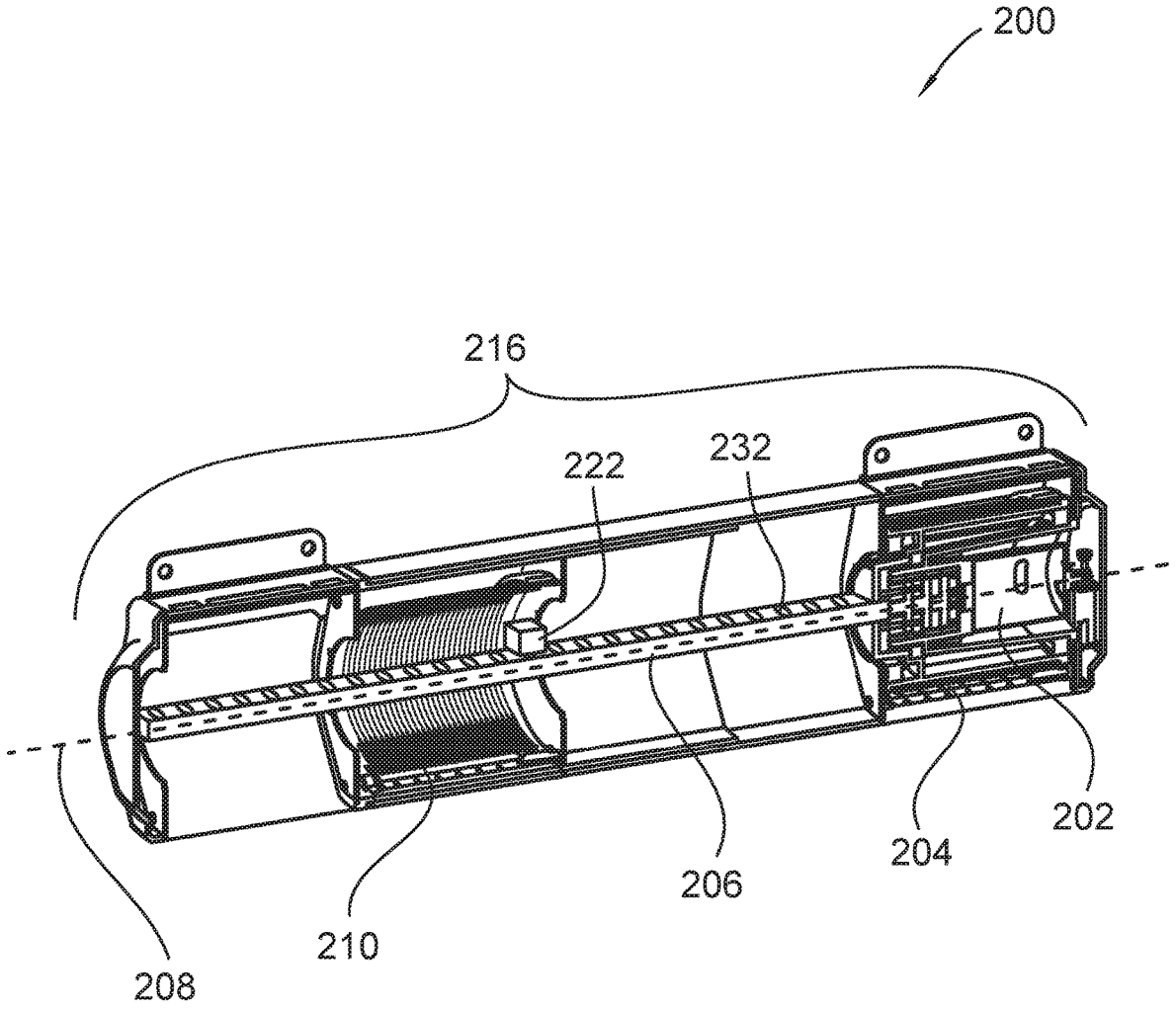
FIG. 2 is a cutaway side view of an adjustable length winch apparatus.

Referring to FIG. 2, a cutaway side view of an adjustable length winch apparatus is shown at 200, according to one embodiment of the present invention. The adjustable length winch apparatus includes first motor 202. First motor 202 is configured to rotate drum 204 and shaft 206 on axis 208. The adjustable length winch apparatus includes second drum 210. Second drum 210 is rotated by shaft 206 and is configured to adjust the distance between first drum 204 and second drum 210 by sliding along shaft 206. Actuator 222 is configured to slide second drum 210 along shaft 206. Second drum 210 interlocks with shaft 206 at positions 232 along the shaft 206. Positions 232 may include divots, holes, or other methods of interlocking. The adjustable length winch apparatus has housing 216. Housing 216 is configured to be mounted to a disparate object.

Figure 3:
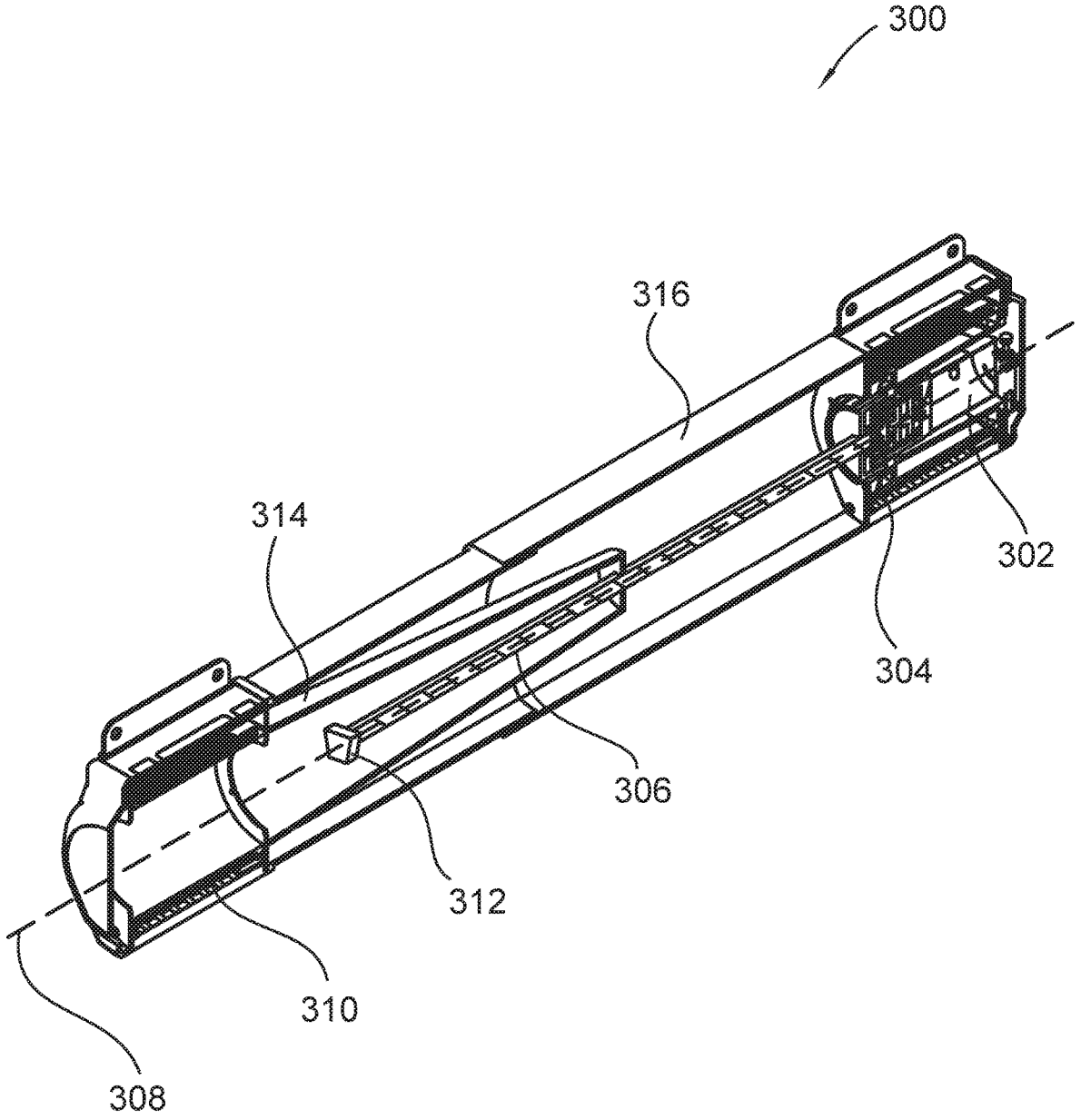
FIG. 3 is a cutaway angled side view of an adjustable length winch apparatus.

Referring to FIG. 3, a cutaway angled side view of an adjustable length winch apparatus is shown at 300, according to one embodiment of the present invention. The adjustable length winch apparatus includes first motor 302. First motor 302 is configured to rotate first drum 304 and shaft 306 on axis 308. The adjustable length winch apparatus further includes second drum 310. Second drum 310 is configured to adjust the distance between first drum 304 and second drum 310 by sliding along shaft 306. First drum 304 is attached to a fixed position on shaft 306. Shaft 306 is a fixed length and has stopper 312. Second drum 310 has extender element 314. Extender element 314 extends beyond the drum and is configured to slide along the shaft. Extender element 314 increases the possible maximum distance between first drum 304 and second drum 310. As the distance between first drum 304 and second drum 310 reaches a maximum, stopper 312 on shaft 306 stops shaft 306 from exiting extender element 314. The adjustable length winch apparatus includes housing 316. Housing 316 is configured to be mounted to a disparate object.

Figure 4A:
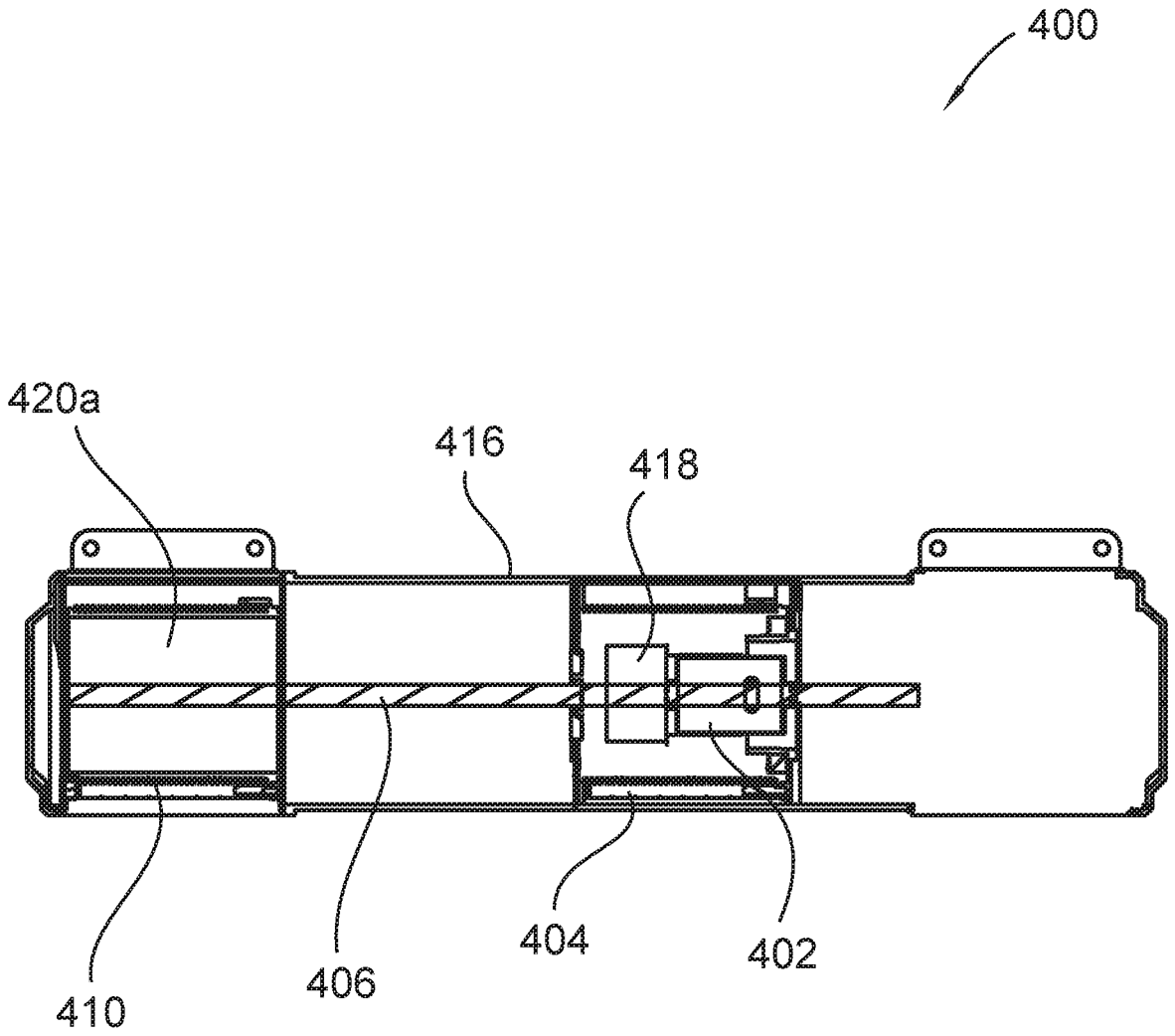
FIG. 4*a* is a cutaway side view of an adjustable length winch apparatus in a maximum length configuration.

Referring to FIG. 4*a*, a cutaway side view of an adjustable length winch apparatus is shown at 400*a*, according to one embodiment of the present invention. The adjustable length winch apparatus includes first motor 402. First motor 402 is configured to rotate first drum 404 and shaft 406 on an axis. Shaft 406 is a fixed length. Second drum 410 is configured to adjust the distance between first drum 404 and second drum 410. Second drum 410 is attached to a fixed position on shaft 406. The adjustable length winch apparatus further includes second motor 418. Second motor 418 drives the shaft such that the distance between first drum 404 and second drum 410 is adjusted. The distance between first drum 404 and second drum 410 is at a maximum position, shown at 420*a*. Second motor 418 may be controlled by a remote device. The remote device may be a smart device. The adjustable length winch apparatus includes housing 416. Housing 416 is configured to be mounted to a disparate object. Housing 416 is configured to enclose the shaft in both the maximum and minimum configurations of first drum 404 and second drum 410.

Figure 4B:
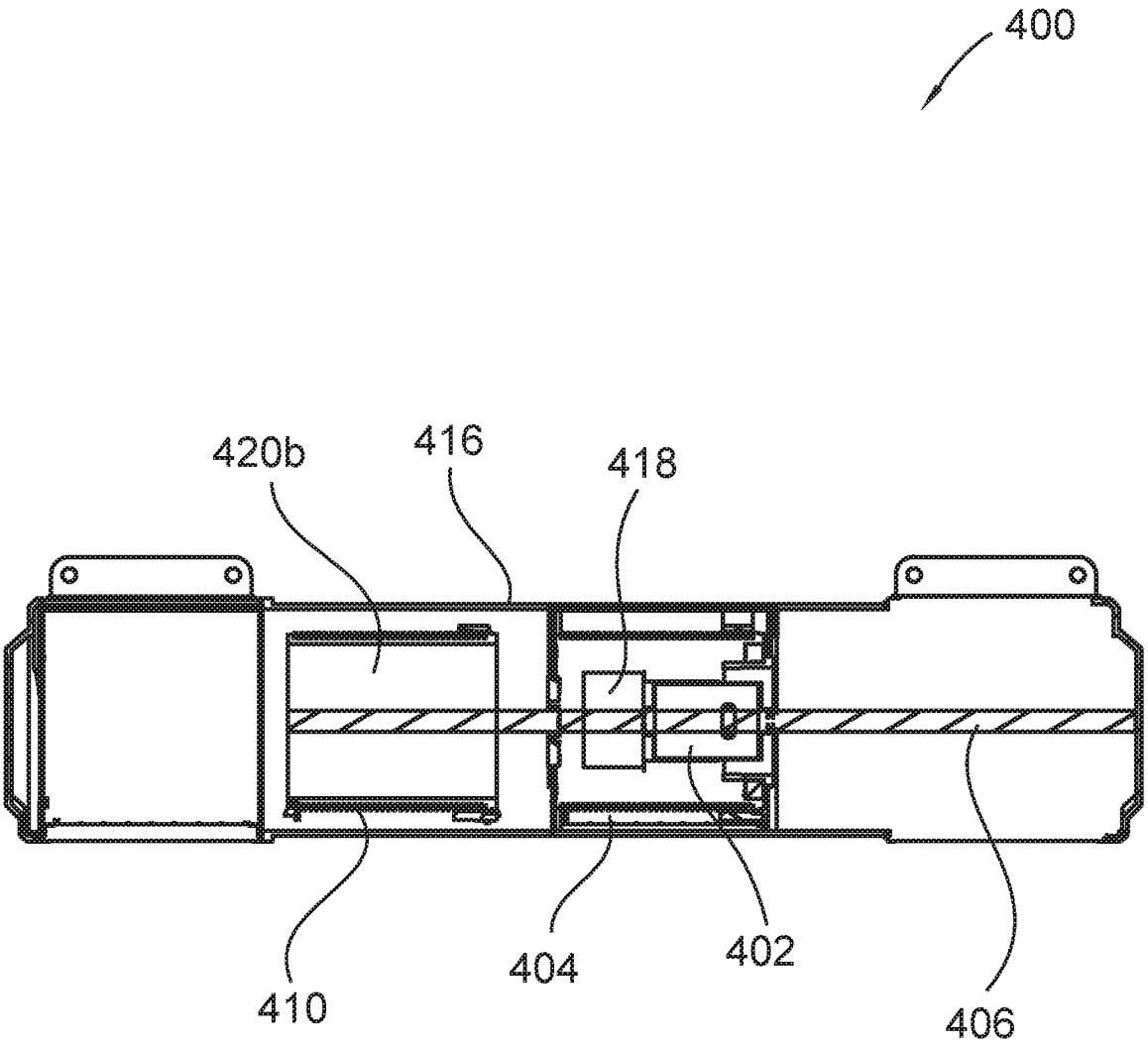
FIG. 4*b* is a cutaway side view of an adjustable length winch apparatus in a minimum length configuration.

Referring to FIG. 4*b*, a cutaway side view of an adjustable length winch apparatus is shown at 400*a*, according to one embodiment of the present invention. The adjustable length winch apparatus includes first motor 402. First motor 402 is configured to rotate first drum 404 and shaft 406 on an axis. Shaft 406 is a fixed length. Second drum 410 is configured to adjust the distance between first drum 404 and second drum 410. Second drum 410 is attached to a fixed position on shaft 406. The adjustable length winch apparatus further includes second motor 418. Second motor 418 drives the shaft such that the distance between first drum 404 and second drum 410 is adjusted. The distance between first drum 404 and second drum 410 is at a minimum position, shown at 420*b*. Second motor 418 may be controlled by a remote device. The remote device may be a smart device. The adjustable length winch apparatus includes housing 416. Housing 416 is configured to be mounted to a disparate object. Housing 416 is configured to enclose the shaft in both the maximum and minimum configurations of first drum 404 and second drum 410.

Figure 5:
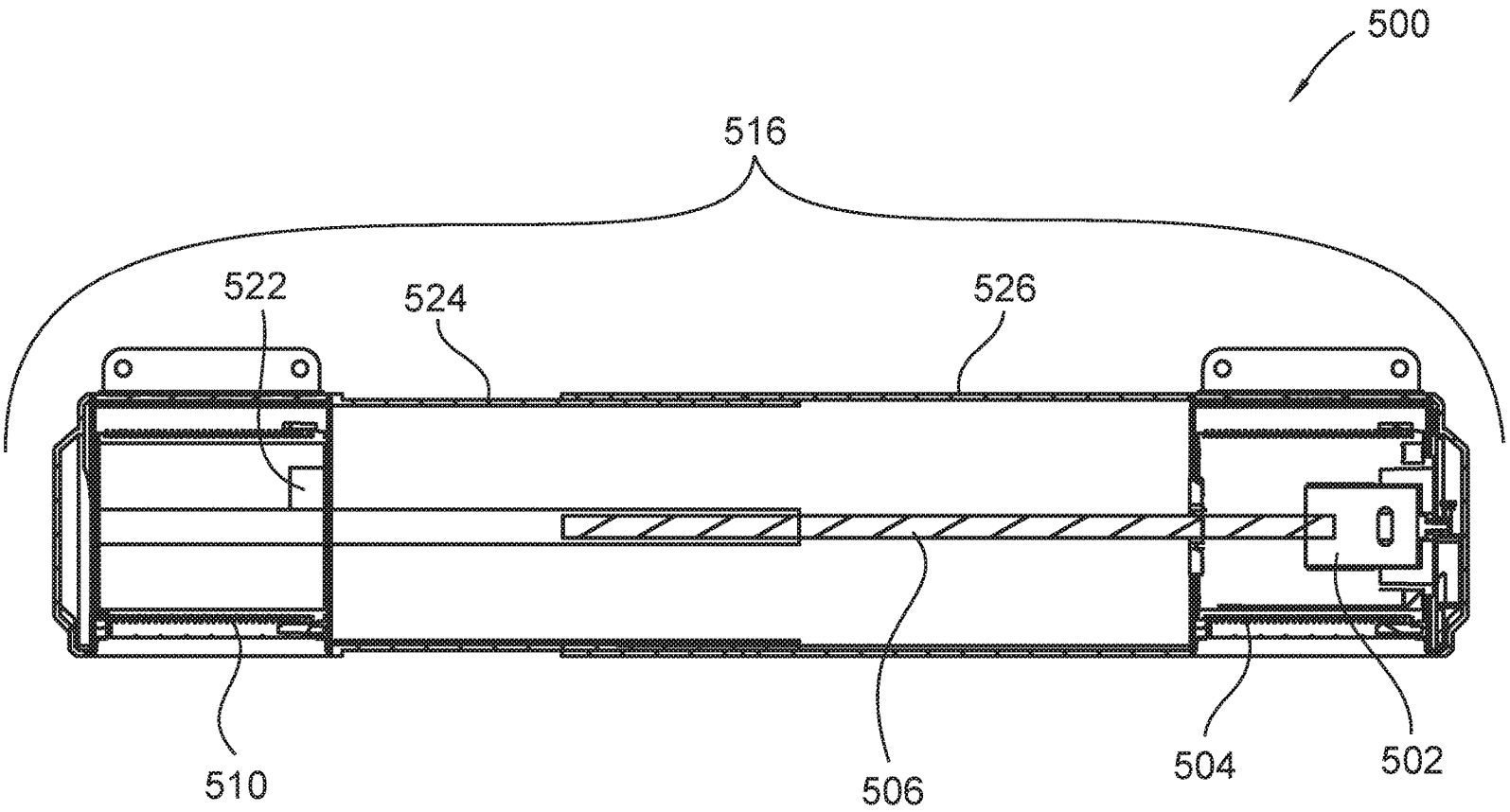
FIG. 5 is a cutaway side view of an adjustable length winch apparatus.

Referring to FIG. 5, a cutaway side view of an adjustable length winch apparatus is shown at 500, according to one embodiment of the present invention. The adjustable length winch apparatus includes first motor 502. First motor 502 is configured to rotate first drum 504 and shaft 506 on an axis. Second drum 510 is configured to adjust the distance between first drum 504 and second drum 510. Shaft 506 is an extension shaft configured to change its length, for example by telescoping within itself. First drum 504 is attached to a first end of shaft 506 and second drum 510 is attached to a second end of shaft 506. Actuator 522 is configured to compress and alternatively extend the shaft 506. As shaft 506 is completely extended, the distance between first drum 504 and second drum 510 is maximized. As shaft 506 is completely compressed, the distance between first drum 504 and second drum 510 is minimized. The adjustable length winch apparatus includes housing 516. Housing 516 has first housing element 524 and second housing element 526. First element 524 can be retracted within and extended from second housing element 526. As first housing element 524 is completely extended from second housing element 526, the distance between first drum 504 and second drum 510 reaches a maximum. As first housing element 524 is completely retracted within second housing element 526, the distance between first drum 504 and second drum 510 reaches a minimum.

Figure 6A:
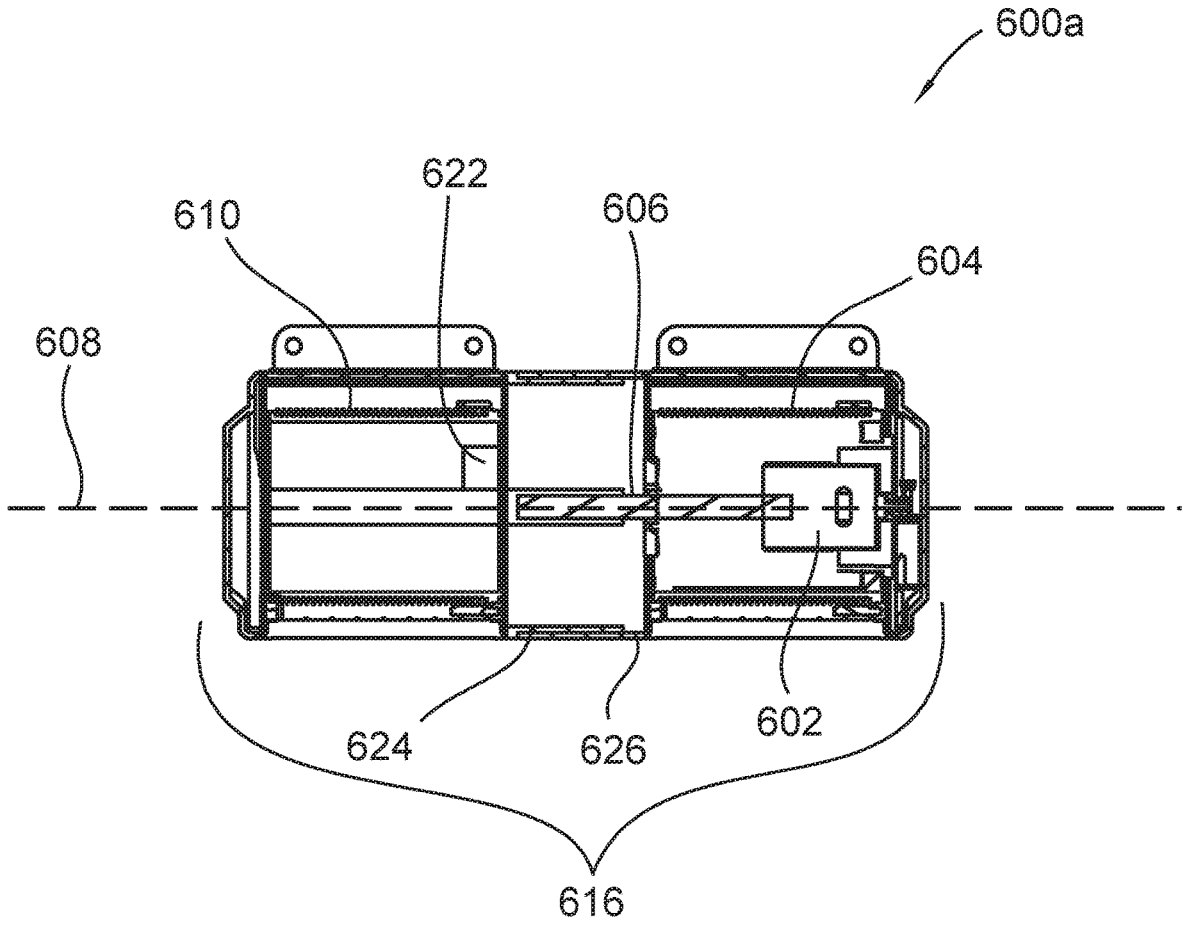
FIG. 6*a* is a cutaway side view of an adjustable length winch apparatus in a minimum length configuration.

Referring to FIG. 6*a*, a cutaway side view of an adjustable length winch apparatus is shown at 600*a*, according to one embodiment of the present invention. The adjustable length winch apparatus includes first motor 602. First motor 602 is configured to rotate first drum 604 and shaft 606 on axis 608. Second drum 610 is configured to adjust the distance between first drum 604 and second drum 610. Shaft 606 is an extension shaft configured to change length. First drum 604 is attached to a first end of shaft 606 and second drum 610 is attached to a second end of shaft 606. Actuator 622 is configured to compress and alternatively extend the shaft 606. Shaft 606 is completely compressed and the distance between first drum 604 and second drum 610 is minimized. The adjustable length winch apparatus includes housing 616. Housing 616 has first housing element 624 and second housing element 626. First housing element 624 is completely retracted within second housing element 626 and the distance between first drum 604 and second drum 610 is at a minimum.

Figure 6B:
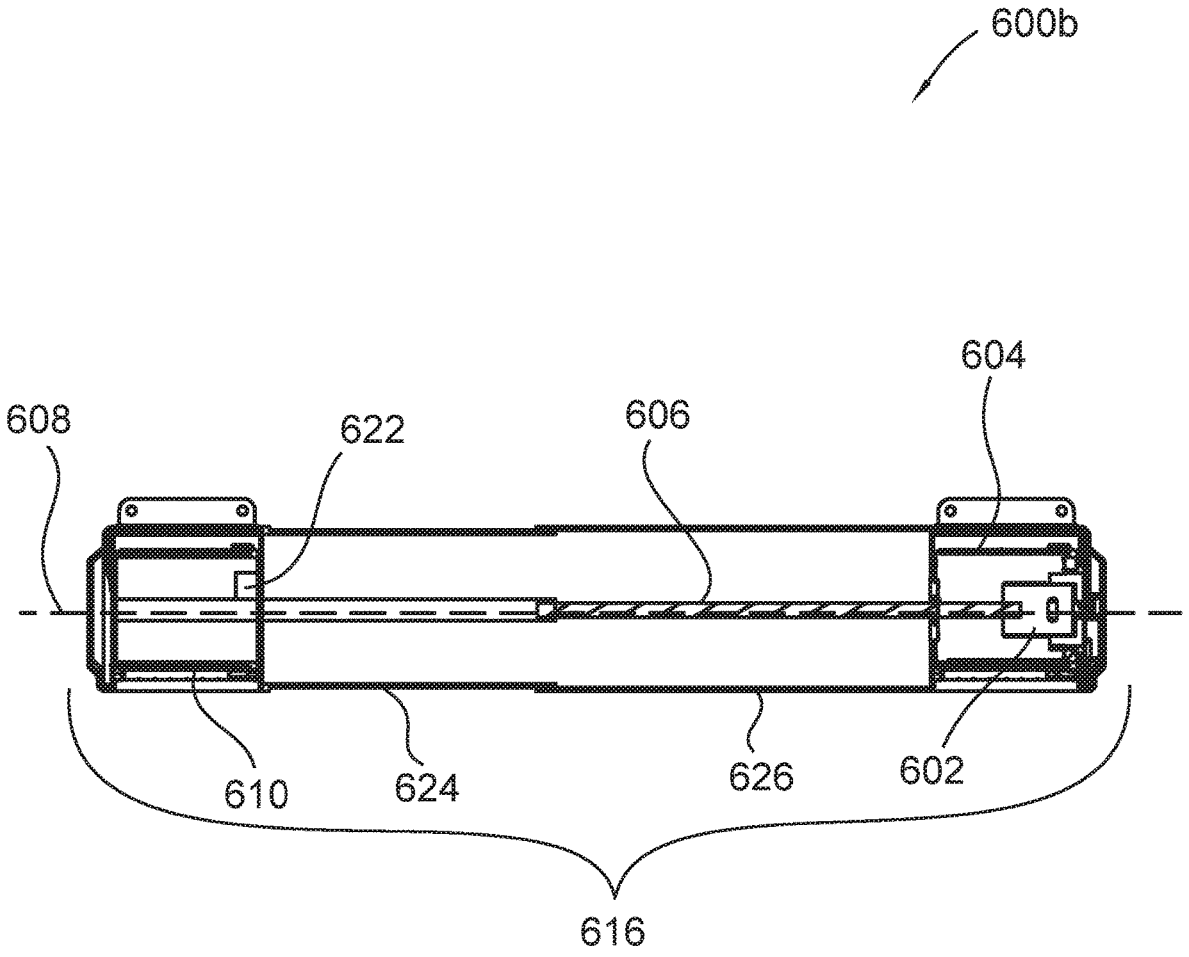
FIG. 6*b* is a cutaway side view of an adjustable length winch apparatus in a maximum length configuration.

Referring to FIG. 6*b*, a cutaway side view of an adjustable length winch apparatus is shown at 600*b*, according to one embodiment of the present invention. The adjustable length winch apparatus includes first motor 602. First motor 602 is configured to rotate first drum 604 and shaft 606 on axis 608. Second drum 610 is configured to adjust the distance between first drum 604 and second drum 610. Shaft 606 is an extension shaft configured to change length. First drum 604 is attached to a first end of shaft 606 and second drum 610 is attached to a second end of shaft 606. Actuator 622 is configured to compress and alternatively extend the shaft 606. Shaft 606 is completely extended and the distance between first drum 604 and second drum 610 is maximized. The adjustable length winch apparatus includes housing 616. Housing 616 has first housing element 624 and second housing element 626. First housing element 624 is completely extended from second housing element 626 and the distance between first drum 604 and second drum 610 is at a maximum.

Figure 7A:
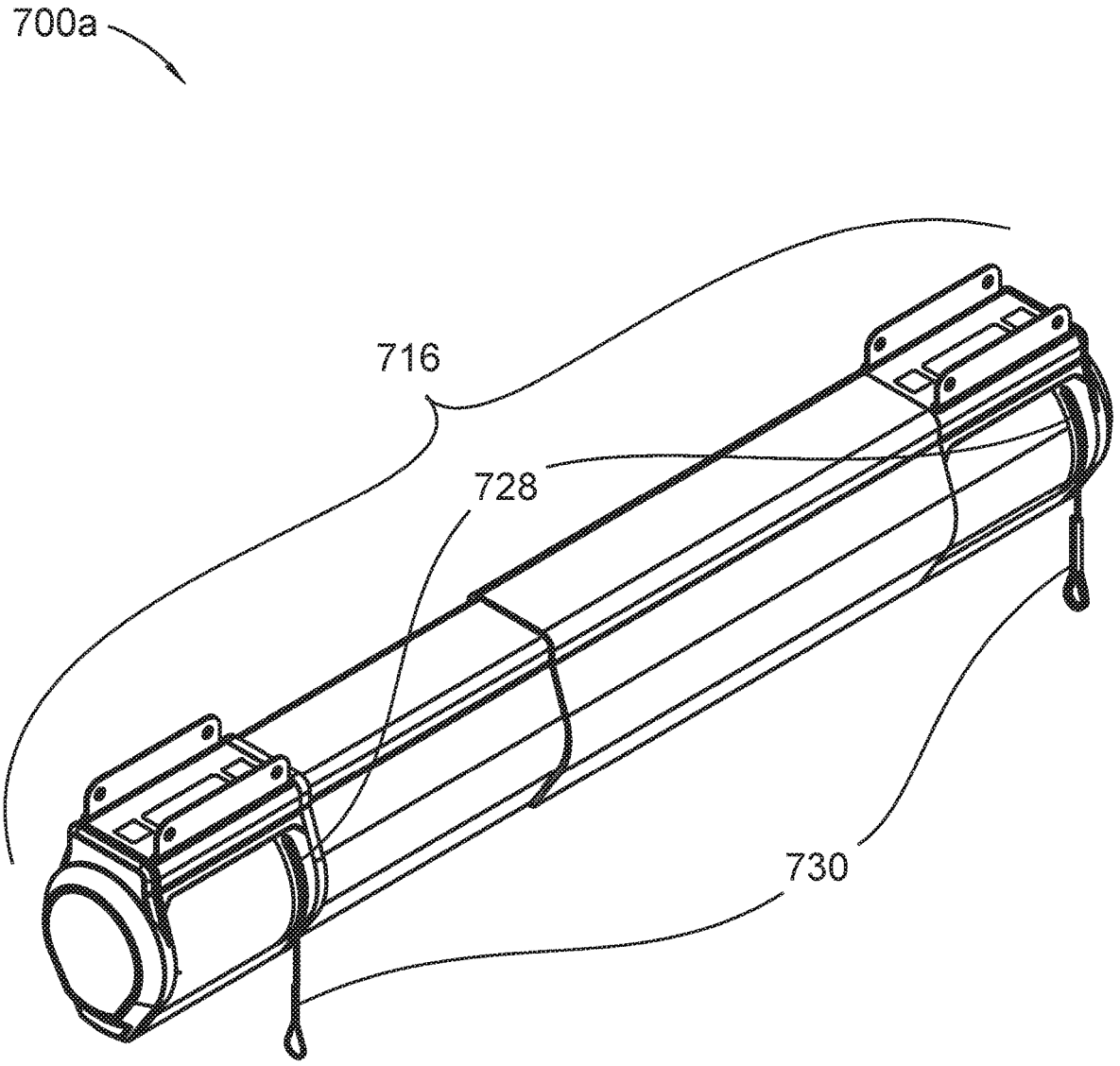
FIG. 7*a* is an angled side view of an adjustable length winch apparatus.

Referring to FIG. 7*a*, an angled side view of an adjustable length winch apparatus is shown at 700*a*, according to one embodiment of the present invention. The adjustable length winch apparatus includes a first motor configured to rotate a first drum and a shaft on an axis. The adjustable length winch apparatus further includes a second drum. The second drum is configured to adjust the distance between the first drum and the second drum. The adjustable length winch apparatus has housing 716. Housing 716 covers the first drum, the shaft, and the second drum. Housing 716 has openings 728 for winch lines 730 to extend from. Housing 716 is configured to be mounted to a disparate object.

Figure 7B:
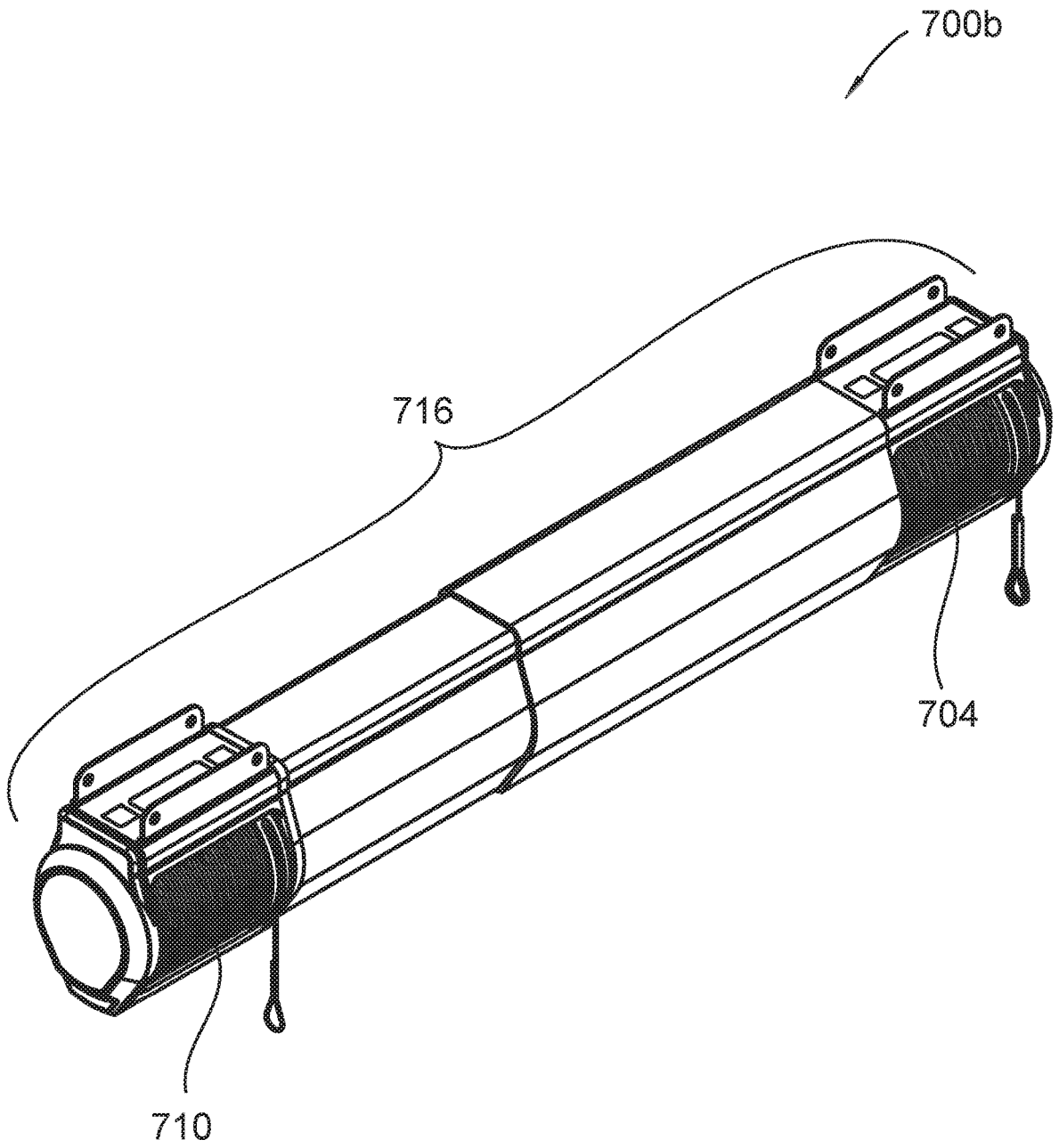
FIG. 7*b* is an angled side view of an adjustable length winch apparatus.

Referring to FIG. 7*b*, an angled side view of an adjustable length winch apparatus is shown at 700*b*, according to one embodiment of the present invention. The adjustable length winch apparatus includes a first motor to configured to rotate first drum 704 and a shaft on an axis. The adjustable length winch apparatus further includes second drum 710. Second drum 710 is configured to adjust the distance between first drum 704 and second drum 710. The adjustable length winch apparatus has housing 716. Housing 716 covers the shaft and is configured to be mounted to a disparate object.

Figure 8:
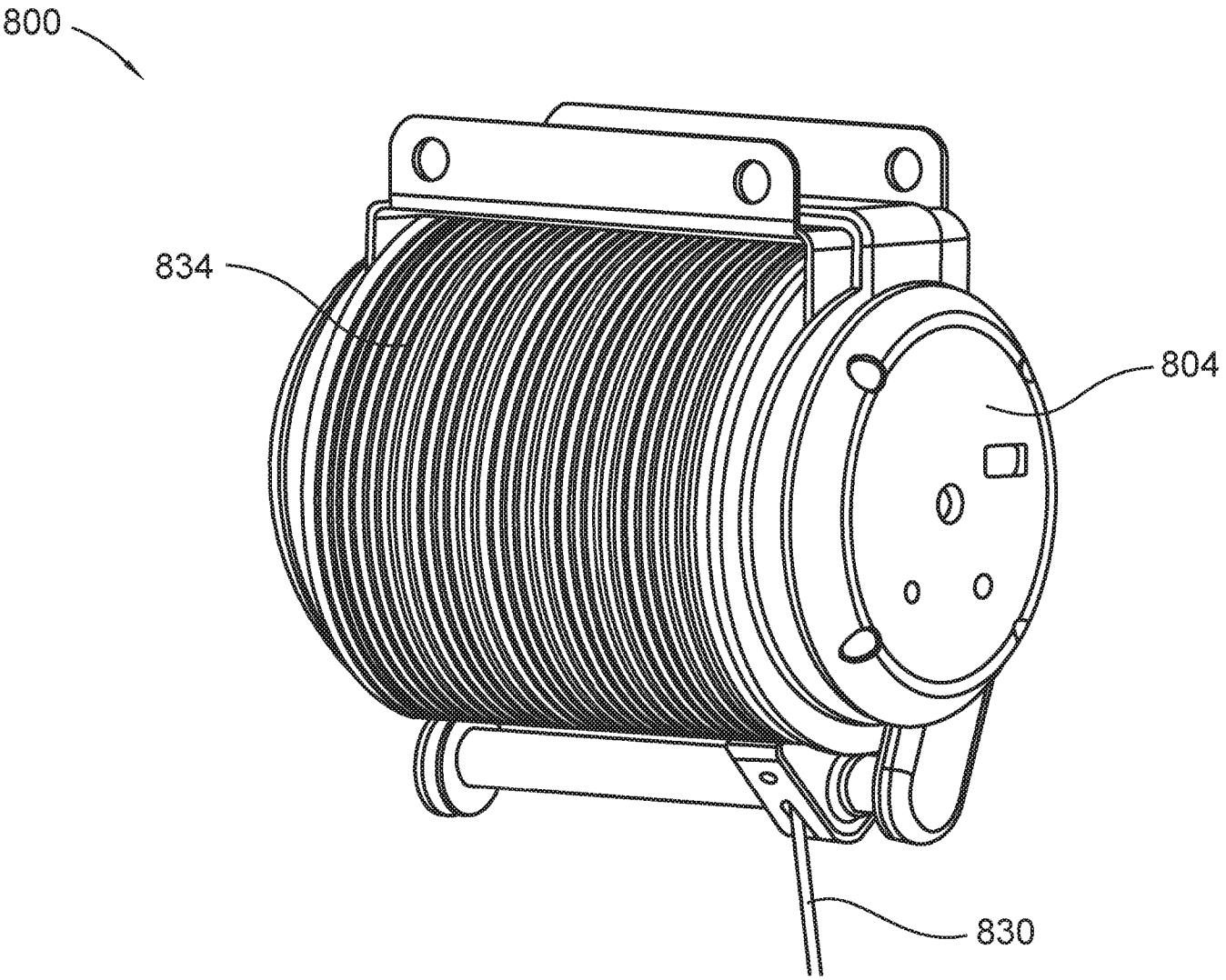
FIG. 8 is an angled side view of a lifting device.

The preferred embodiment of the winch apparatus is a modified version of one or more of the lifting devices described in U.S. Pat. Nos. 9,399,566, 9,567,194, 9,873,600, 9,908,754, 9,988,250, 9,975,745, 9,988,251 the entire contents of which are incorporated herein by reference. These lifting devices are available from GarageSmart under the brand "MyLifter®." Referring to FIG. 8, an angled side view of a simplified description of one such lifting device is shown at 800. The lifting device has grooved drum 804 on which line 830 is wound. The lifting device also includes guide 834 for winding line 830 on drum 804. Drum 804 of the lifting device spools and unspools line 830. The motor and transmission are located within drum 804. The lifting device is also equipped with a controller. Preferably, the controller is assembled on a printed circuit board (PCB) and includes a wireless transmitter, a processor and memory. The wireless transmitter of the controller connects the lifting device to a mobile device. The mobile device is configured to run an app for controlling the lifting device. Through the app the controller causes the motor to turn drum 804. As drum 804 turns in one direction, line 830 unspools from drum 804. As drum 804 spools in the other direction, line 830 spools onto drum 804.

In some embodiments, the first motor is controlled by a remote device. The remote device may include a smart device, such as a smartphone running an app. Preferably, the remote device is a device that provides a user interface, where the user can at least see current settings for the adjustable length winch apparatus. More preferably, the remote device provides a user interface, where the user can see the current settings and provide instructions to the adjustable length winch apparatus to control functions.

In some embodiments, the second motor is also controlled by a remote device. The remote device is preferably the same smartphone running the same app. Preferably, the remote device is a device that provides a user interface, where the user can at least see current settings for the adjustable length winch apparatus. More preferably, the remote device provides a user interface, where the user can see the current settings and provide instructions to the adjustable length winch apparatus to control functions.

In some embodiments, the actuator is controlled by a remote device. The remote device may include a smart device. Preferably, the remote device is a device that provides a user interface, where the user can at least see current settings for the adjustable length winch apparatus. More preferably, the remote device provides a user interface, where the user can see the current settings and provide instructions to the adjustable length winch apparatus to control functions.

In some embodiments, the housing may be opened for access to the first drum, shaft, and second drum.

All patents and published patent applications referred to herein are incorporated herein by reference.

The invention has been described with reference to various specific and preferred embodiments and techniques. Nevertheless, it is understood that many variations and modifications may be made while remaining within the spirit and the scope of the invention.

What is claimed is:

1. An adjustable length winch apparatus comprising:
- a first motor configured to rotate a first drum and a shaft on an axis;
- a second drum adapted to be rotated by the shaft on the axis; and
- a mechanical actuator;
- wherein the shaft and second drum are configured to adjust the distance between the first and second drum;
- wherein the first drum is attached to a fixed position on the shaft;
- wherein the second drum is configured to slide along the shaft;
- wherein the mechanical actuator is configured to slide the second drum along the shaft.

2. The invention of claim 1, further comprising a housing configured to be mounted to a disparate object.

3. The invention of claim 2, wherein the first motor is controlled by a remote device.

4. The invention of claim 3, wherein the shaft is a fixed length.

5. The invention of claim 1, wherein the second drum comprises an extender element, wherein the extender element extends beyond the drum and is configured to slide along the shaft.

6. The invention of claim 5, wherein the second drum is configured to interlock with the shaft at one or more positions along the shaft.

7. The invention of claim 3, wherein the actuator is controlled by the remote device.

8. An adjustable length winch apparatus comprising:
- a first motor configured to rotate a first drum and a shaft on an axis;
- a second drum adapted to be rotated by the shaft on the axis; and
- a second motor;
- wherein the shaft and second drum are configured to adjust the distance between the first and second drum;
- wherein the second drum is attached to the shaft at a fixed position;
- wherein the second motor is configured to adjust the distance between the first and second drum by extending and retracting the shaft.

9. The invention of claim 8, wherein the second motor is controlled by a remote device.

10. An adjustable length winch apparatus comprising:
- a first motor configured to rotate a first drum and a shaft on an axis;
- a second drum adapted to be rotated by the shaft on the axis; and
- wherein the shaft and second drum are configured to adjust the distance between the first and second drum;

wherein the second drum is attached to the shaft at a fixed position;

wherein the shaft is an extension shaft configured to change length.

11. The invention of claim 10, wherein the first drum is attached to a first end of the extension shaft and the second drum is attached to a second end of the extension shaft.

12. The invention of claim 11, wherein the extension shaft retracts within either the first or second drum.

13. The invention of claim 12, further comprising an actuator configured to extend and retract the shaft.

14. The invention of claim 13, further comprising a housing having a first housing element and a second housing element, wherein the first housing element can be retracted within and extended from the second housing element.

15. The invention of claim 14, wherein as the first housing element is extended from the second housing element, the distance between the first and second drum reaches a maximum, and as the first housing element is retracted within the second housing element, the distance between the first and second drum reaches a minimum.

16. The invention of claim 15, wherein the first housing element may be separated from the second housing element to provide access to the first drum, shaft, and second drum.

* * * * *